US005453066A

United States Patent [19]

Richter, Jr.

[11] Patent Number: 5,453,066

[45] Date of Patent: Sep. 26, 1995

[54] HORSE RIDING TYPE EXERCISER

[76] Inventor: Charles E. Richter, Jr., The Chicago Consulting Group, 312 S. Third St., Geneva, Ill. 60134

[21] Appl. No.: 393,671

[22] Filed: Feb. 24, 1995

[51] Int. Cl.[6] ..... A63B 69/06

[52] U.S. Cl. ..... 482/96; 482/57

[58] Field of Search ..... 482/71, 95, 96, 482/130, 137, 57, 72

[56] References Cited

U.S. PATENT DOCUMENTS

| | | | |
|---|---|---|---|
| 2,642,288 | 6/1953 | Bell | 482/96 |
| 2,924,456 | 2/1960 | Miller | 482/96 |
| 4,300,760 | 11/1981 | Bobroff | 482/96 |
| 5,156,650 | 10/1992 | Bals | 482/95 |
| 5,366,428 | 11/1994 | Liao | 482/96 |

*Primary Examiner*—Stephen R. Crow

*Attorney, Agent, or Firm*—Morton J. Rosenberg; David I. Klein

[57] ABSTRACT

A horse riding type exerciser includes a base, a pair of foot support and a handle bar pivotally coupled to the front portion of the base. A pair of discs are rotatably secured to the middle portion of the base and pivotally coupled to the foot supports. A seat support is secured to the discs and rotated in concert with the discs. A beam pivotally couples the bottom end of the handle bar to either the upper or the lower portion of the discs such that the seat support may be rotated counterclockwise when the handle bar is either pulled toward or pushed away from the seat support.

2 Claims, 4 Drawing Sheets

HORSE RIDING TYPE EXERCISER

BACKGROUND OF THE INVENTION

1. Field of the Invention

The present invention relates to an exerciser, and more particularly to a horse riding type exerciser.

2. Description of the Prior Art

Typical horse riding type exercisers are pull type exercisers, i.e., the handle bar may be pulled for conducting horse riding type exercises. The exercisers may not be used as push type exercisers.

The present invention has arisen to mitigate and/or obviate the afore-described disadvantages of the conventional horse riding type exercisers.

SUMMARY OF THE INVENTION

The primary objective of the present invention is to provide a horse riding type exerciser which may be used both as pull type and push type exercisers.

In accordance with one aspect of the invention, there is provided a horse riding type exerciser comprising a base including a middle portion having a pivotal axle provided thereon and including a front portion having a pivotal shaft provided thereon, a pair of foot support including an upper portion pivotally coupled to the pivotal shaft, a handle bar including a lower portion pivotally coupled to the pivotal shaft and including a bottom end, a pair of discs rotatably secured to the pivotal axle and including an upper portion located above the pivotal axle and including a lower portion located below the pivotal axle, link means for pivotally coupling the discs to the foot supports, a seat support secured to the discs and rotated in concert with the discs, a first rod secured to the upper portion of the discs, and a beam pivotally coupling the first rod to the bottom end of the handle bar. The discs are rotated counterclockwise by the beam when the handle bar is pulled toward the seat support.

A second rod is further secured to the lower portion of the discs, the beam being pivotally coupling the second rod to the bottom end of the handle bar, and the discs being rotated counterclockwise by the beam when the handle bar is pushed away from the seat support.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
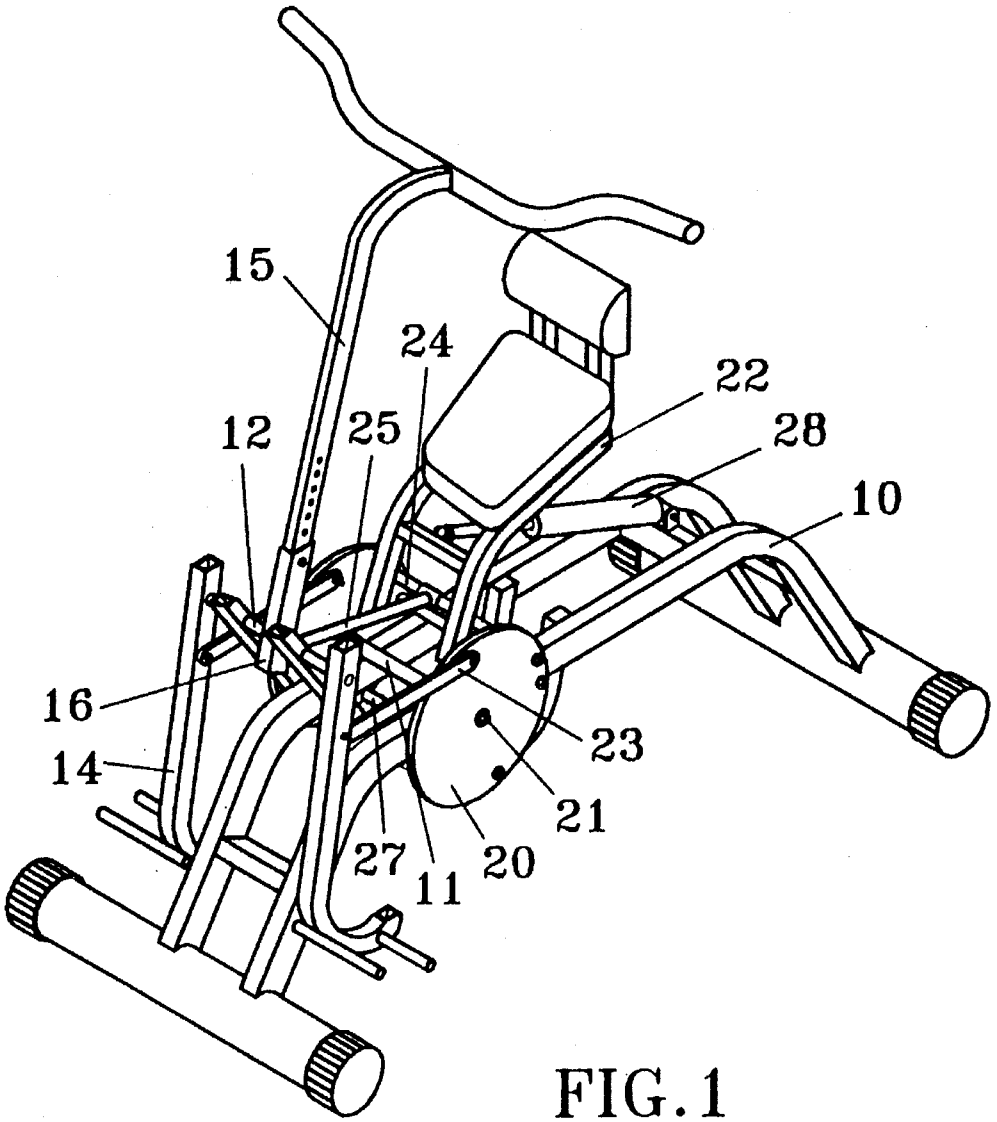
FIG. 1 is a perspective view of a horse riding type exerciser in accordance with the present invention.
Figure 2:
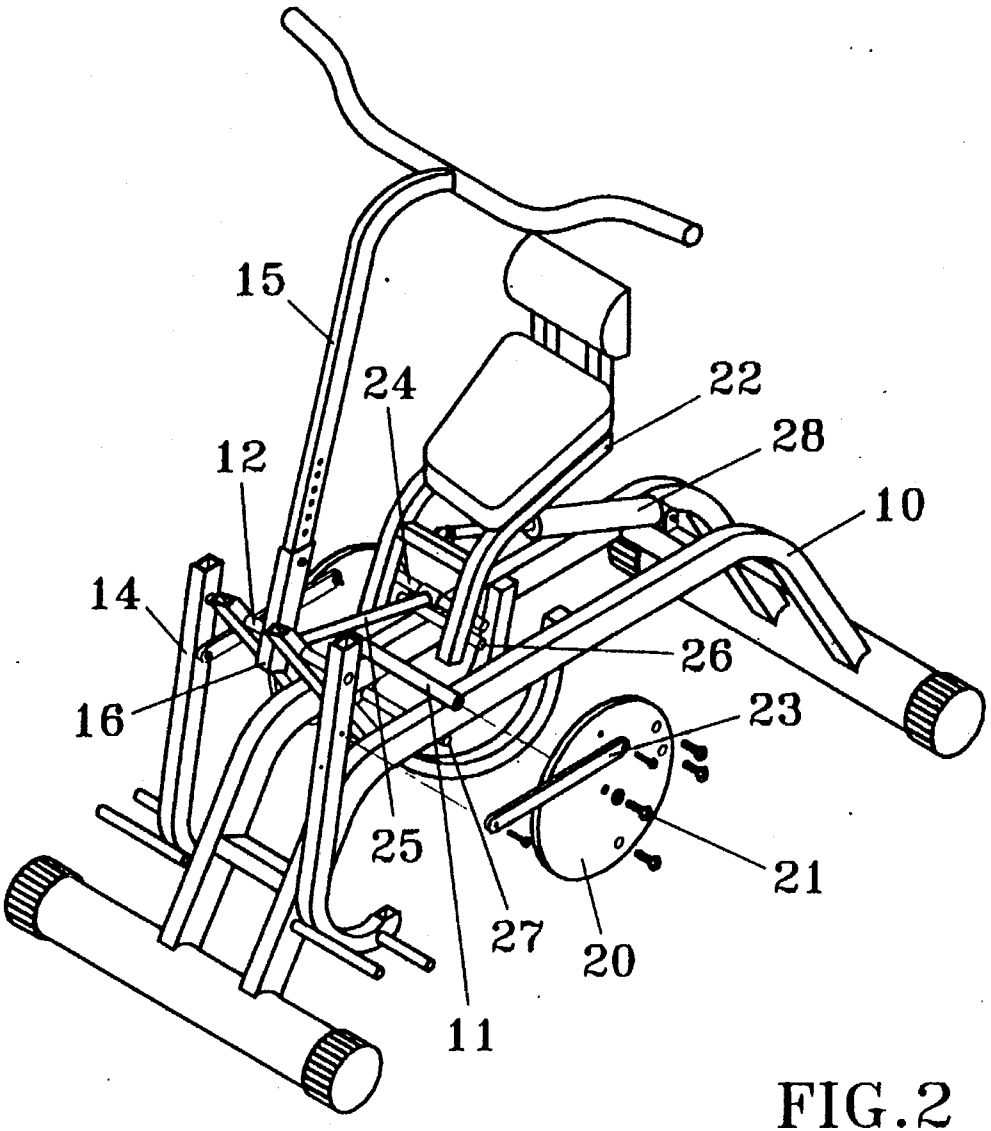
FIG. 2 is a partial exploded view of the horse riding type exerciser.
Figure 3:
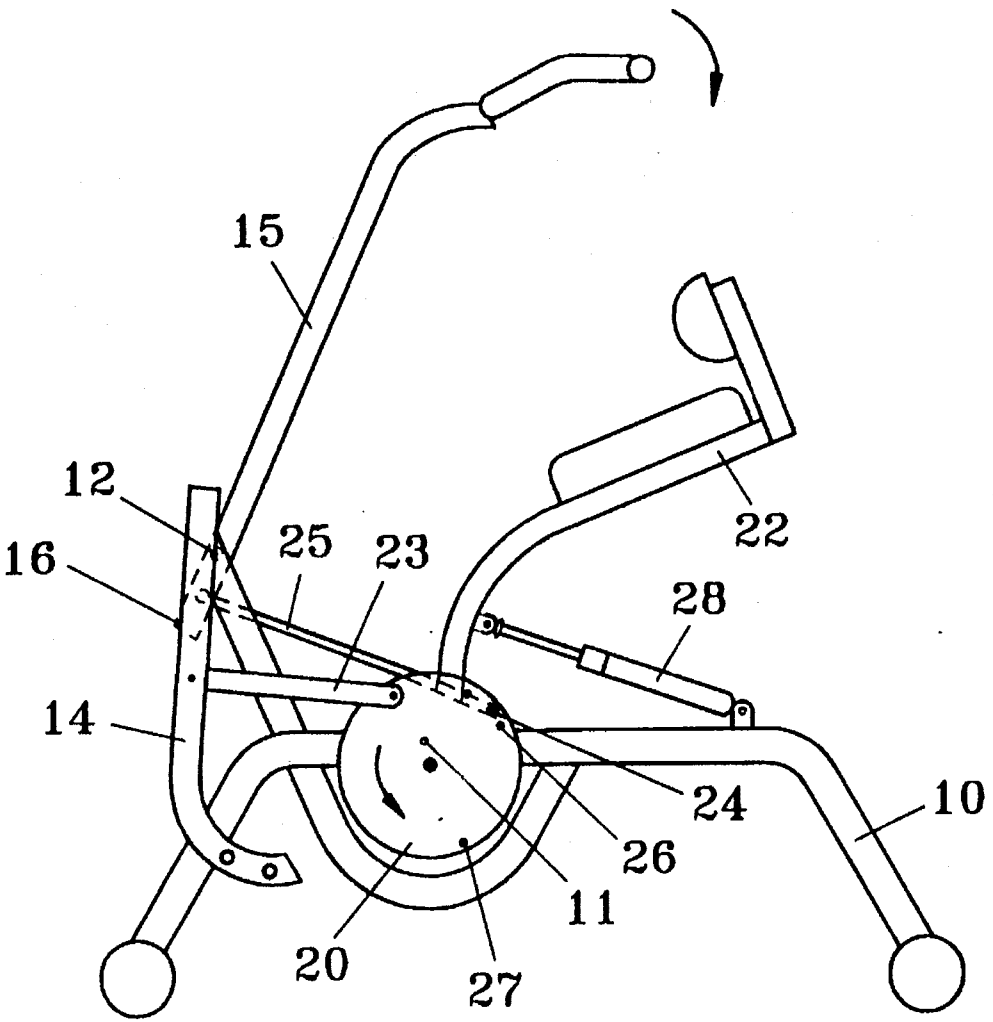
FIGS. 3 and 4 are plane views illustrating the operation of the horse riding type exerciser.

Referring to the drawings, and initially to FIGS. 1 to 3, a horse riding type exerciser in accordance with the present invention comprises a base 10 including a pivotal axle 11 provided on the middle portion and a pivotal shaft 12 provided on the front and upper portion. A pair of foot supports 14 include an upper portion pivotally coupled to the pivotal shaft 12. A handle bar 15 includes a lower end pivotally coupled to the pivotal shaft 12 and includes a bottom end 16 located below the pivotal shaft 12. The handle bar 15 includes an adjustable configuration that may be adjusted to different height for different users.

A pair of discs 20 are rotatably secured to the pivotal axle 11 by fastening screws 21. A seat support 22 is fixed to the discs 20 and rotated in concert with the discs 20. A pair of links 23 pivotally couple the foot supports 14 to the upper portions of the discs 20 respectively. A rod 24 is secured between the discs 20 and located above the pivotal axle 11. A beam 25 pivotally couples the rod 24 to the bottom end 16 of the handle bar 15 such that the discs 20 may be rotated counterclockwise by the handle bar 15 when the handle bar 15 is pulled by the users, best shown in FIG. 3. A stick 26 is further fixed between the discs 20 for engaging with the base 10 so as to limit the rotational movement of both the discs 20 and the seat support 22. Another rod 27 is secured between the discs 20 and located below the pivotal axle 11 and may be coupled to the bottom end 16 of the handle bar 15 by the beam 25. An actuator 28 is coupled between the seat support 22 and the base 10 so as to provide resistance to the seat support 22 and to the handle bar 15.

In operation, as shown in FIG. 3, when the beam 25 is coupled between the bottom end 16 of the handle bar 15 and the rod 24, and when the handle bar 15 is pulled by the users, the discs 20 and thus the seat support 22 may be rotated counterclockwise by the beam 25 against the weight of the users and against the resistance provided by the actuator 28.

Figure 4:
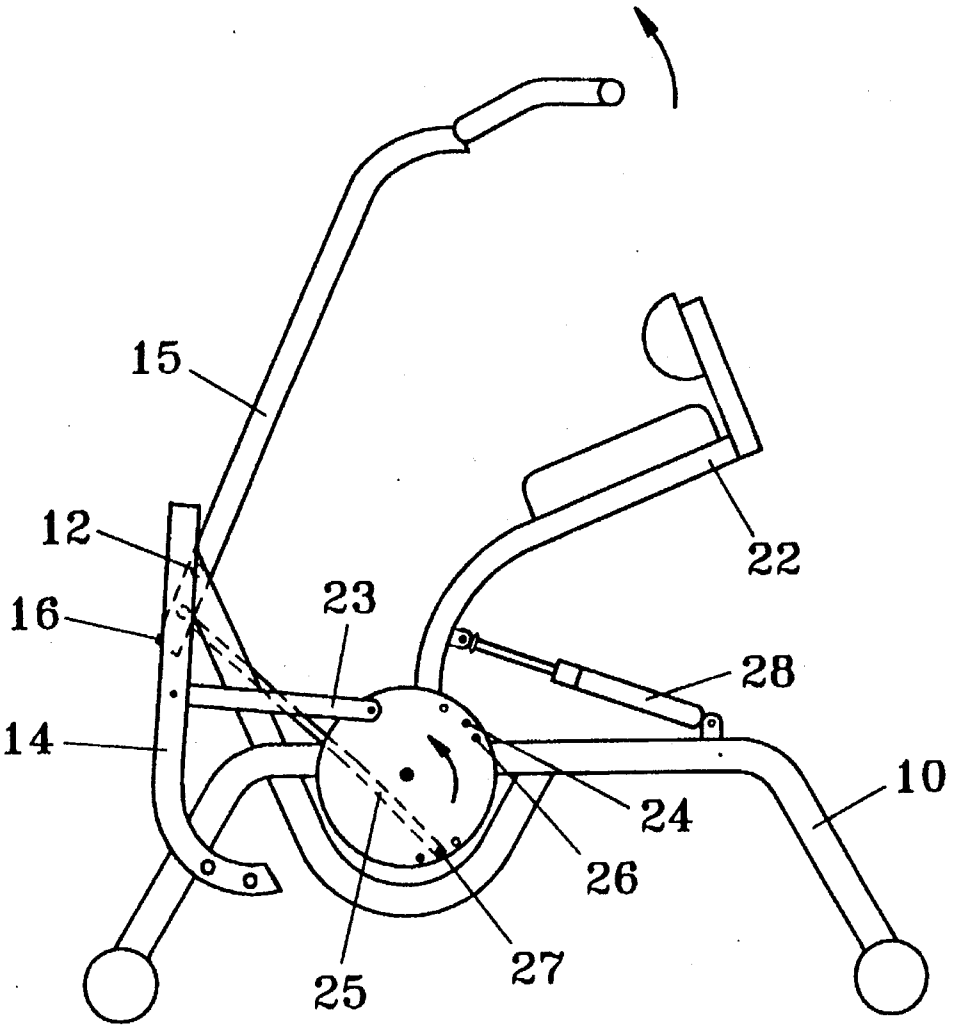

However, as shown in FIG. 4, when the beam 25 is coupled between the bottom end 16 of the handle bar 15 and the other rod 27, and when the handle bar 15 is pushed by the users, the discs 20 and thus the seat support 22 may also be rotated counterclockwise by the beam 25 against the weight of the users and against the resistance provided by the actuator 28.

Accordingly, the horse riding type exerciser in accordance with the present invention may be used for conducting both pull type and push type horse riding exercises.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A horse riding type exerciser comprising:

a base including a middle portion having a pivotal axle provided thereon and including a front portion having a pivotal shaft provided thereon, a pair of foot support including an upper portion pivotally coupled to said pivotal shaft, a handle bar including a lower portion pivotally coupled to said pivotal shaft and including a bottom end, a pair of discs rotatably secured to said pivotal axle and including an upper portion located above said pivotal axle and including a lower portion located below said pivotal axle, link means for pivotally coupling said discs to said foot supports, a seat support secured to said discs and rotated in concert with said discs, a first rod secured to said upper portion of said discs, and a beam pivotally coupling said first rod to said bottom end of said handle bar, said discs being rotated counterclockwise by said beam when said handle bar is pulled toward said seat support.

2. A horse riding type exerciser according to claim 1 further comprising a second rod secured to said lower portion of said discs, said beam being pivotally coupling said second rod to said bottom end of said handle bar, and said discs being rotated counterclockwise by said beam when said handle bar is pushed away from said seat support.

* * * * *